US007093329B1

(12) United States Patent
Chiu

(10) Patent No.: US 7,093,329 B1
(45) Date of Patent: Aug. 22, 2006

(54) ELASTIC SNAPPING DEVICE

(76) Inventor: Ciber Chiu, 54-6, Chi Parn Lane, Gou Cheng Li, Lu Kang, Changhua Hsien (TW)

( * ) Notice: Subject to any disclaimer, the term of this patent is extended or adjusted under 35 U.S.C. 154(b) by 0 days.

(21) Appl. No.: 10/968,501

(22) Filed: Oct. 19, 2004

(51) Int. Cl.
*A44B 13/02* (2006.01)

(52) U.S. Cl. ..... 24/301; 24/301; 24/300

(58) Field of Classification Search ..... 24/300, 24/298, 265 W, 301, 235 W; 600/206
See application file for complete search history.

(56) References Cited

U.S. PATENT DOCUMENTS 4,694,541 A * 9/1987 Skyba ..... 24/301
4,754,531 A * 7/1988 Skyba ..... 24/300
6,202,263 B1 * 3/2001 Harker ..... 24/300
6,868,586 B1 * 3/2005 Hall ..... 24/115 A

* cited by examiner

*Primary Examiner*—Robert J. Sandy
*Assistant Examiner*—Marcus Menezes
(74) *Attorney, Agent, or Firm*—Alan D. Kamrath; Nikolai & Mersereau, P.A.

(57) ABSTRACT

An elastic snapping device includes an elastic cord having two distal ends each formed with an end opening, a snapping tool mounted on the elastic cord and having a distal end formed with an enlarged plug inserted into the end opening of the elastic cord, and an elastic sleeve mounted on a connection of the elastic cord and the snapping tool. Thus, the elastic sleeve is mounted on the connection of the elastic cord and the snapping tool closely, so that the snapping tool is combined with the elastic cord rigidly and stably, thereby preventing the snapping tool from detaching from the elastic cord during a long-term utilization.

9 Claims, 8 Drawing Sheets

ELASTIC SNAPPING DEVICE

BACKGROUND OF THE INVENTION

1. Field of the Invention

The present invention relates to an elastic snapping device, and more particularly to an elastic snapping device that is used with an exercising equipment or used to bind an article.

2. Description of the Related Art

A conventional elastic snapping device in accordance with the prior art shown in FIG. 8 comprises an elastic cord 6 having two distal ends each formed with an end opening 60, and a snapping tool 7 having a movable gate 74 for closing a mouth 72 of the snapping tool 7, the snapping tool 7 mounted on the elastic cord 6 and having a distal end formed with an enlarged plug 70 inserted into the end opening 60 of a respective one of the two distal ends of the elastic cord 6. However, the snapping tool 7 is not combined with the elastic cord 6 rigidly, so that the snapping tool 7 is easily detached from the elastic cord 6 during a long-term utilization. In addition, the snapping tool 7 will detach from the elastic cord 6 due to an excessive force, so that the elastic snapping device is not used safely, thereby easily causing danger to a user.

SUMMARY OF THE INVENTION

In accordance with the present invention, there is provided an elastic snapping device, comprising:

an elastic cord having two distal ends each formed with an end opening;

a snapping tool mounted on the elastic cord and having a distal end formed with an enlarged plug inserted into the end opening of a respective one of the two distal ends of the elastic cord; and an elastic sleeve mounted on a connection of the elastic cord and the snapping tool closely.

The primary objective of the present invention is to provide an elastic snapping device having an enhanced strength.

Another objective of the present invention is to provide an elastic snapping device, wherein the elastic sleeve is mounted on the connection of the elastic cord and the snapping tool closely, so that the snapping tool is combined with the elastic cord rigidly and stably, thereby preventing the snapping tool from detaching from the elastic cord during a long-term utilization.

A further objective of the present invention is to provide an elastic snapping device, wherein the snapping tool will not detach from the elastic cord due to an excessive force, so that the elastic snapping device is used safely, thereby preventing the elastic snapping device from causing danger to a user.

Further benefits and advantages of the present invention will become apparent after a careful reading of the detailed description with appropriate reference to the accompanying drawings.

DETAILED DESCRIPTION OF THE INVENTION

Figure 1:
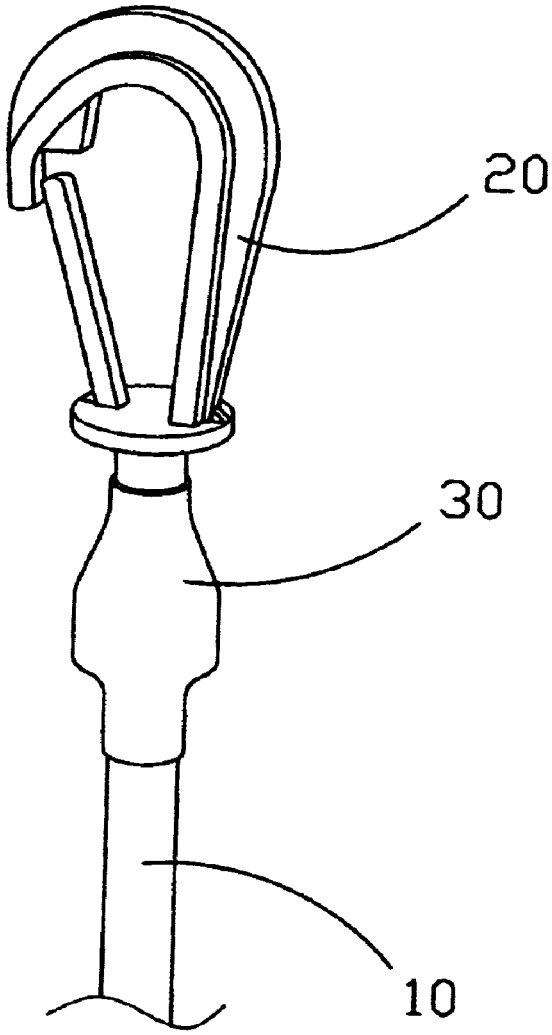
FIG. 1 is a partially cut-away perspective view of an elastic snapping device in accordance with the preferred embodiment of the present invention.
Figure 2:
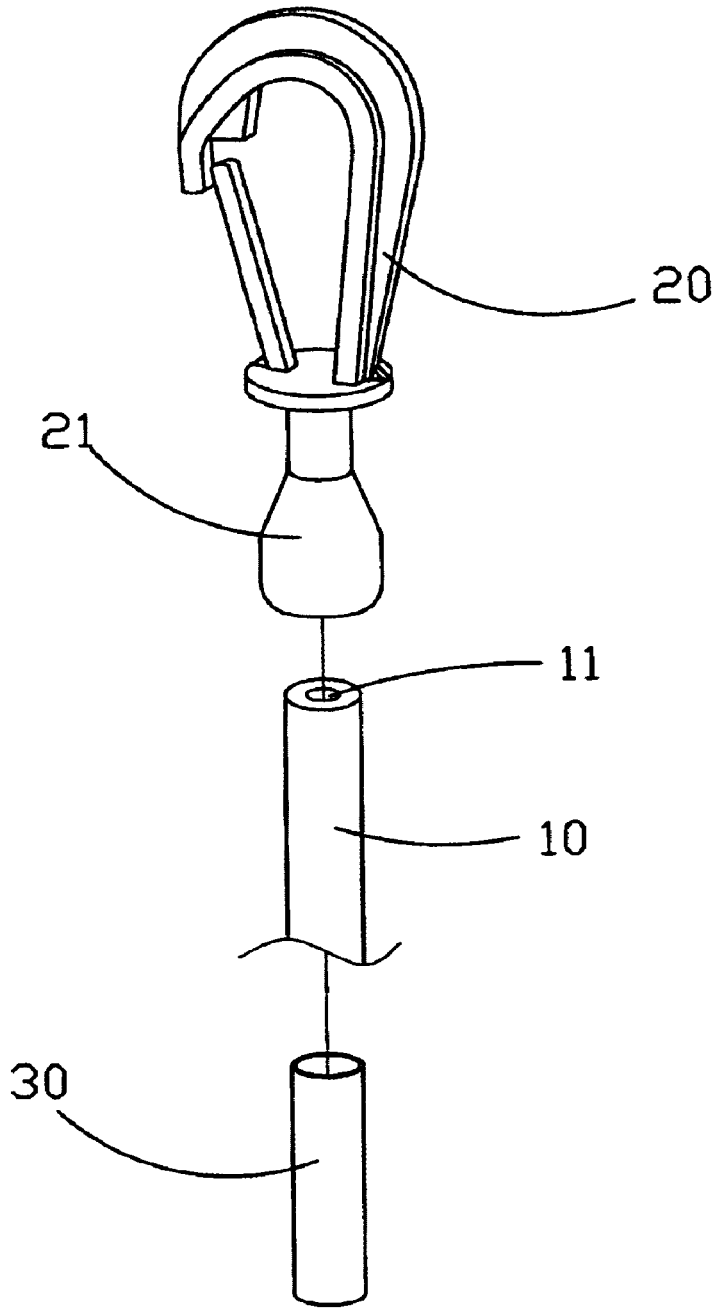
FIG. 2 is an exploded perspective view of the elastic snapping device as shown in FIG. 1.
Figure 3:
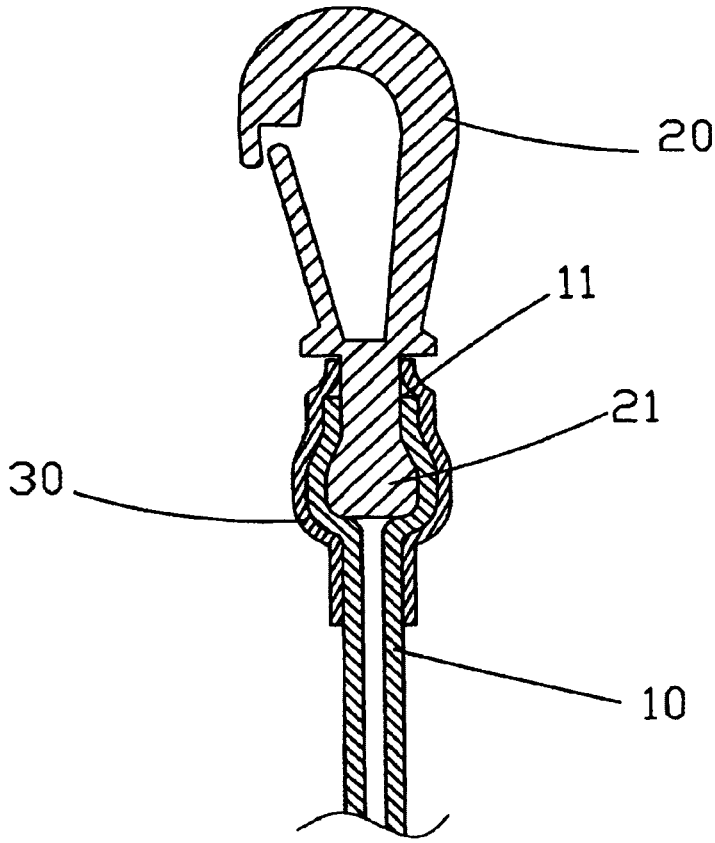
FIG. 3 is a plan cross-sectional view of the elastic snapping device as shown in FIG. 1.

Referring to the drawings and initially to FIGS. 1–3, an elastic snapping device in accordance with the preferred embodiment of the present invention comprises a hollow elastic cord 10 having two distal ends each formed with an end opening 11, a hook-shaped snapping tool 20 mounted on the elastic cord 10 and having a distal end formed with an enlarged plug 21 inserted into the end opening 11 of a respective one of the two distal ends of the elastic cord 10, and an elastic sleeve 30 mounted on a connection of the elastic cord 10 and the snapping tool 20 closely. The snapping tool 20 having a mouth 22 and a movable gate 24 for closing the mouth 22.

The end opening 11 of the elastic cord 10 is expanded outward by the enlarged plug 21 of the snapping tool 20, and the elastic sleeve 30 is expanded outward by the end opening 111 of the elastic cord 10 and the enlarged plug 21 of the snapping tool 20. Preferably, the elastic sleeve 30 is mounted on a connection of the end opening 111 of the elastic cord 10 and the enlarged plug 21 of the snapping tool 20 closely.

In such a manner, the elastic sleeve 30 is mounted on the connection of the elastic cord 10 and the snapping tool 20 closely, so that the snapping tool 20 is combined with the elastic cord 10 rigidly and stably, thereby preventing the snapping tool 20 from detaching from the elastic cord 10 during a long-term utilization. In addition, the snapping tool 20 will not detach from the elastic cord 10 due to an excessive force, so that the elastic snapping device is used safely, thereby preventing the elastic snapping device from causing danger to a user.

Figure 4:
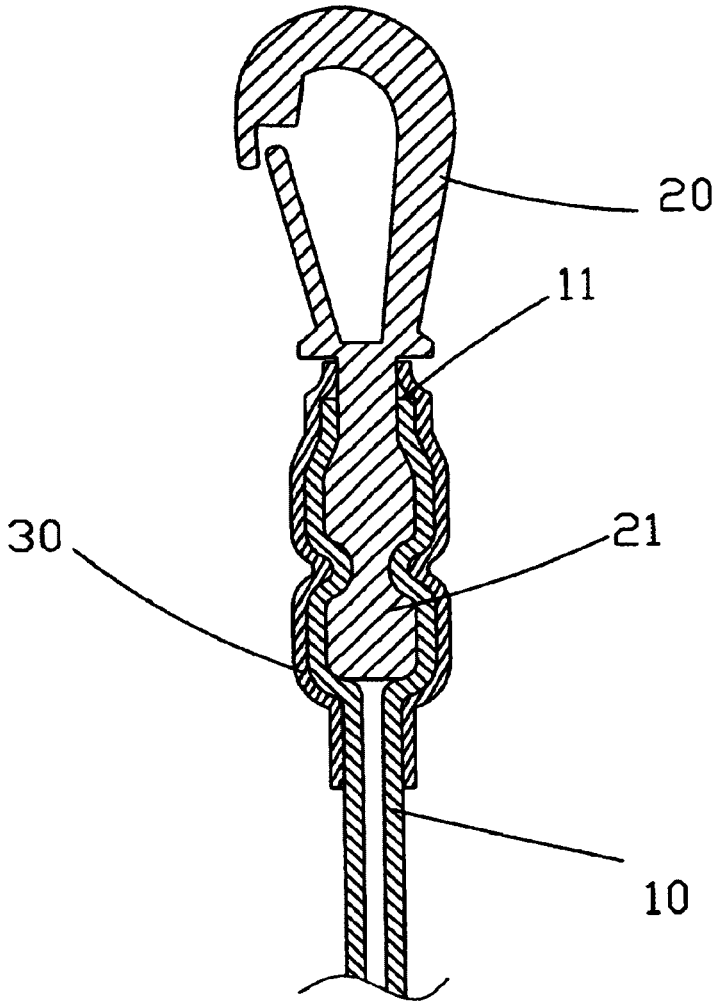
FIG. 4 is a plan cross-sectional view of an elastic snapping device in accordance with another embodiment of the present invention.

As shown in FIG. 4, the enlarged plug 21 of the snapping tool 20 has a different shape.

Figure 5:
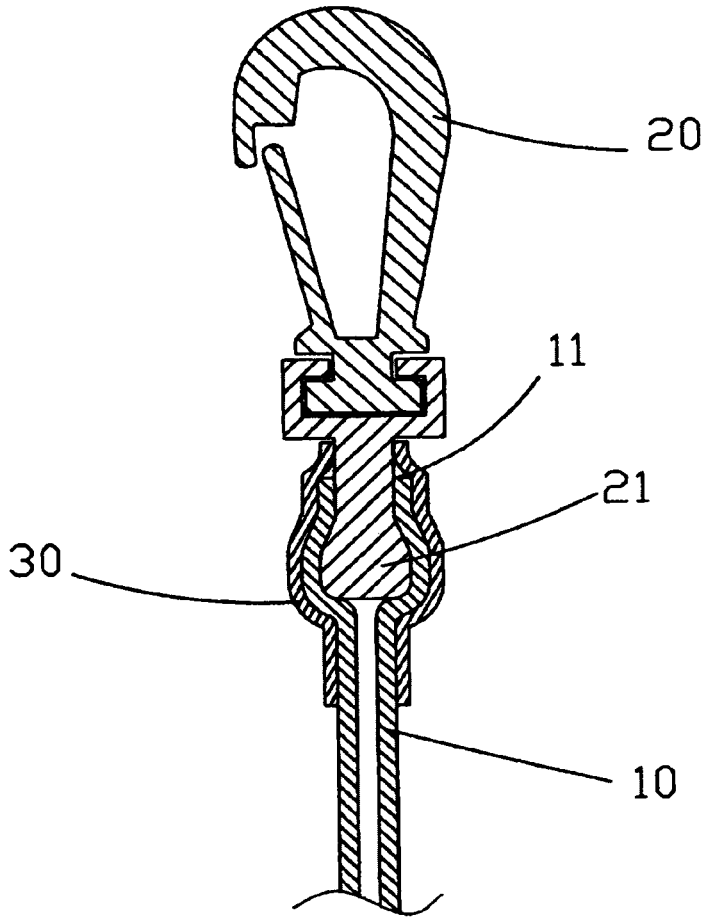
FIG. 5 is a plan cross-sectional view of an elastic snapping device in accordance with another embodiment of the present invention.

As shown in FIG. 5, the snapping tool 20 has a different shape.

Figure 6:
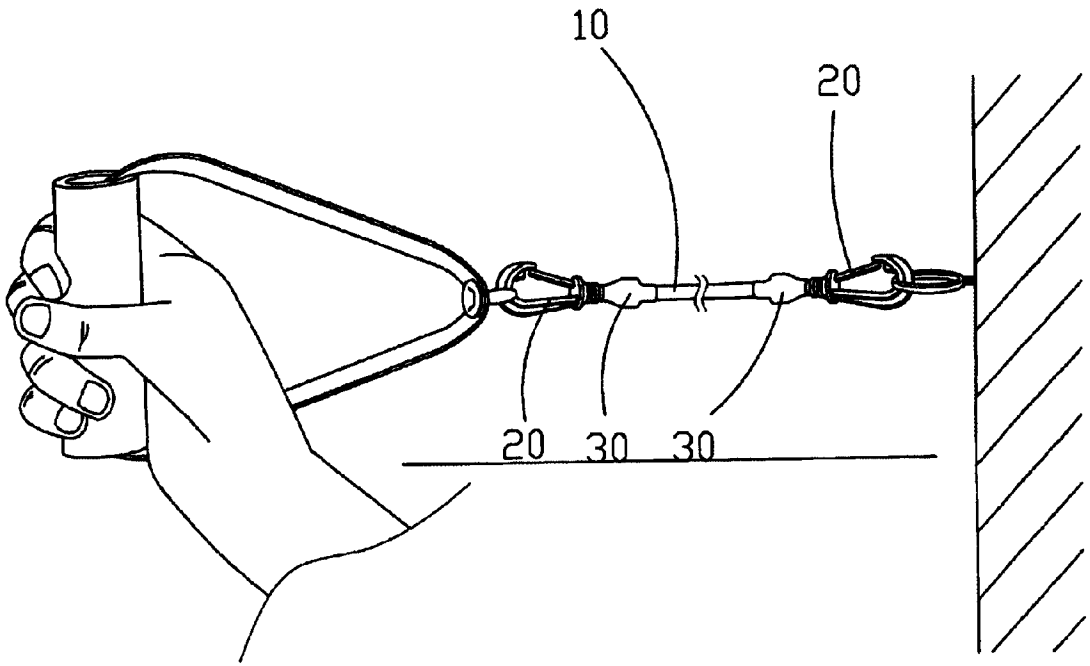
FIG. 6 is a schematic operational view of the elastic snapping device as shown in FIG. 1 in use.

As shown in FIG. 6, the elastic snapping device comprises two snapping tools 20, so that the elastic snapping device is used with an exercising equipment.

Figure 7:
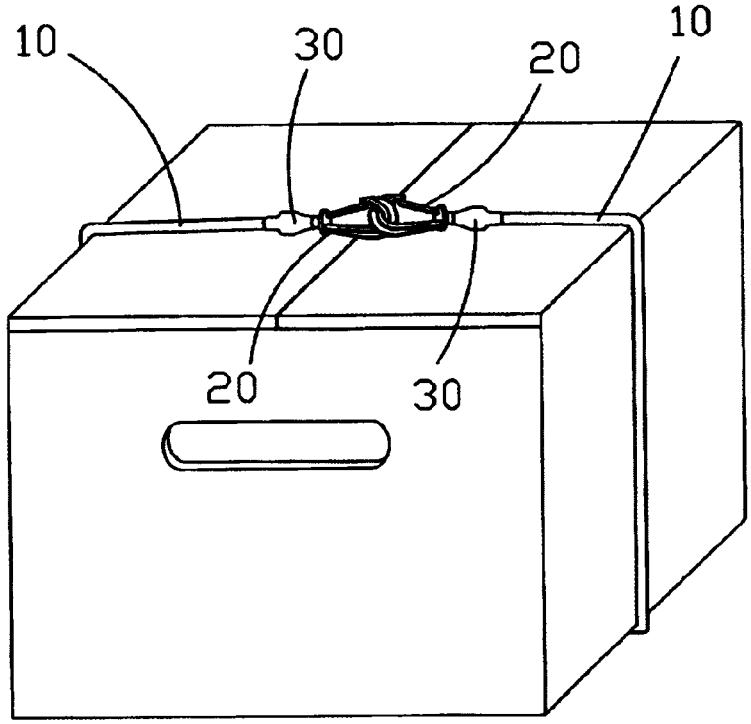
FIG. 7 is a schematic operational view of the elastic snapping device as shown in FIG. 1 in use.
Figure 8:
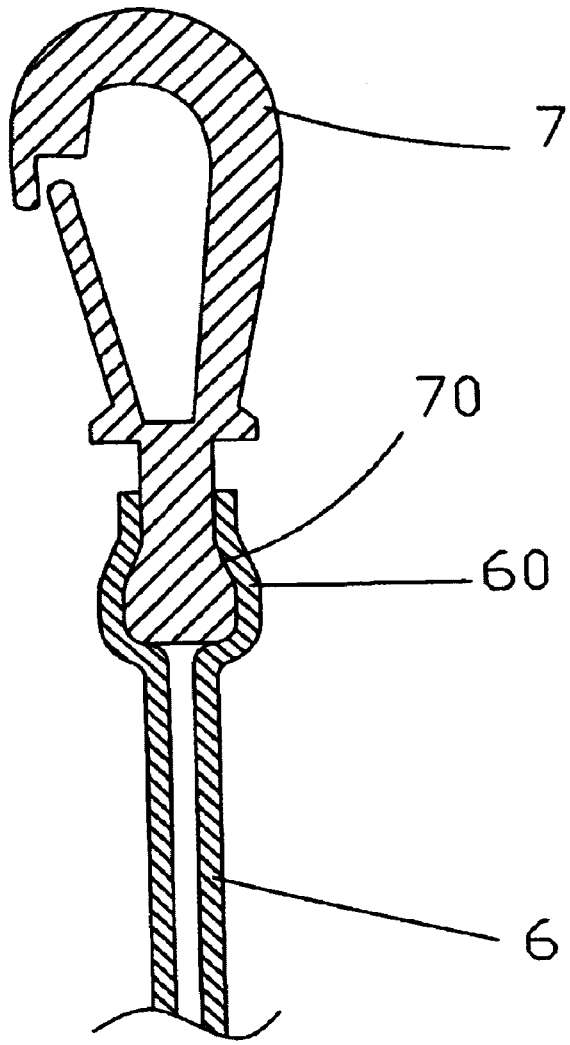
FIG. 8 PRIOR ART
FIG. 8 is a partially cut-away plan cross-sectional assembly view of a conventional elastic snapping device in accordance with the prior art.

As shown in FIG. 7, the elastic snapping device comprises two snapping tools 20, so that the elastic snapping device is used to bind an article.

Accordingly, the elastic sleeve 30 is mounted on the connection of the elastic cord 10 and the snapping tool 20 closely, so that the snapping tool 20 is combined with the elastic cord 10 rigidly and stably, thereby preventing the snapping tool 20 from detaching from the elastic cord 10 during a long-term utilization. In addition, the snapping tool 20 will not detach from the elastic cord 10 due to an excessive force, so that the elastic snapping device is used safely, thereby preventing the elastic snapping device from causing danger to a user.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An elastic snapping device, comprising:

an elastic cord having two distal ends each formed with an end opening;

a snapping tool mounted on the elastic cord and having a distal end formed with an enlarged plug inserted into the end opening of a respective one of the two distal ends of the elastic cord the snapping tool having a mouth, and a movable gate for closing the mouth; and an elastic sleeve directly mounted on a connection of the elastic cord and the snapping tool closely in a close fit manner;

wherein the enlarged plug of the snapping tool has a first portion extending from the distal end of the snapping tool and a second portion extending from and having a dimension greater than that of the first portion and closely fitted into the respective end opening of the elastic cord.

2. The elastic snapping device in accordance with claim 1, wherein the elastic cord has a hollow inside.

3. The elastic snapping device in accordance with claim 1, wherein the end opening of the elastic cord is expanded outward by the enlarged plug of the snapping tool.

4. The elastic snapping device in accordance with claim 3, wherein the elastic sleeve is expanded radially outward by an outward force of the end opening of the elastic cord and the enlarged plug of the snapping tool.

5. The elastic snapping device in accordance with claim 1, wherein the elastic sleeve is directly mounted on a connection of the end opening of the elastic cord and the enlarged plug of the snapping tool closely in a close fit manner.

6. The elastic snapping device in accordance with claim 1, wherein the elastic sleeve has a longitudinal length smaller than that of the elastic cord.

7. The elastic snapping device in accordance with claim 5, wherein the end opening of the elastic cord is clamped between the elastic sleeve and the enlarged plug of the snapping tool closely.

8. The elastic snapping device in accordance with claim 5, wherein the elastic sleeve is closely fitted onto the connection of the end opening of the elastic cord and the enlarged plug of the snapping tool.

9. The elastic snapping device in accordance with claim 5, wherein the elastic sleeve has a first portion rested on the enlarged plug of the snapping tool, a mediate portion fitted onto the connection of the end opening of the elastic cord and the enlarged plug of the snapping tool and a second portion rested on the respective distal end of the elastic cord.

* * * * *